United States Patent [19]

Hollberg et al.

[11] Patent Number: 5,028,300

[45] Date of Patent: Jul. 2, 1991

[54] AROMATIC POLYAMIDE PAPER WITH THICKENED EDGE AREAS AND PROCESS FOR MAKING SAME

[75] Inventors: Peter J. Hollberg; Layton T. Hulette, both of Richmond, Va.

[73] Assignee: E. I. du Pont de Nemours and Company, Wilmington, Del.

[21] Appl. No.: 552,219

[22] Filed: Jul. 13, 1990

Related U.S. Application Data

[63] Continuation-in-part of Ser. No. 400,407, Aug. 31, 1989, abandoned.

[51] Int. Cl.[5] ..... D21F 11/00

[52] U.S. Cl. ..... 162/115; 162/109; 162/146; 162/195; 162/208

[58] Field of Search ..... 162/109, 310, 146, 286, 162/195, 115, 208, 308, 297; 428/157, 192, 337, 340

[56] References Cited

U.S. PATENT DOCUMENTS

| | | | |
|---|---|---|---|
| 3,493,463 | 2/1970 | Baker | 162/109 |
| 3,756,908 | 9/1973 | Gross | 162/146 |
| 4,239,591 | 12/1980 | Blake | 162/109 |
| 4,818,343 | 4/1989 | Laine | 162/286 |

FOREIGN PATENT DOCUMENTS

| | | | |
|---|---|---|---|
| 667 | of 1879 | United Kingdom | 162/208 |

*Primary Examiner*—Peter Chin

[57] ABSTRACT

Disclosed is an elongate, nonwoven flexible sheet structure and a method for its manufacture. The sheet structure consists essentially of a commingled mixture of about 45 to about 70% by weight short fibers of aromatic polyamide and about 30 to about 55% by weight fibrids of poly(meta-phenylene isophthalamide). The sheet structure has an interior thickness remote from the edges of between about 75 and about 150 microns with a thickened area along and adjacent each of the side edges having a maximum thickness which is at least about 5% greater in average thickness than the interior thickness of the sheet along and adjacent the thickened areas.

23 Claims, 3 Drawing Sheets

AROMATIC POLYAMIDE PAPER WITH THICKENED EDGE AREAS AND PROCESS FOR MAKING SAME

CROSS-REFERENCE TO RELATED APPLICATION

This is a continuation-in-part of application Ser. No. 07/400,407, filed Aug. 31, 1989 abandoned.

BACKGROUND OF THE INVENTION

The present invention relates to nonwoven, aromatic polyamide sheet structures and methods for making such sheet structures and more particularly relates to thin, aromatic polyamide paper with a thickened area along its edges to facilitate calendering and a method for its manufacture Nonwoven, aromatic polyamide sheet structures such as the poly(meta-phenylene isophthalamide) papers sold under the trademark NOMEX by E. I du Pont de Nemours and Company are useful in a variety of applications requiring resistance to thermal degradation and/or electrical insulative properties. For many such applications, papers which have been calendered at high temperatures and pressures are advantageously employed due to their enhanced mechanical properties. However, thin aromatic polyamide papers, for example, uncalendered thickness less than about 150 microns, are difficult to calendar. Frequently, "work roll wraps" occur, that is, papers adhere to the hot calendar rolls and wrap around the entire work roll causing a sheet break. Work roll wraps can thereby cause loss of a product and significant downtime in the calendering process.

For thin aromatic polyamide papers, one of the primary causes of calendar work roll wraps is excessive fibrid which clings loosely to short fibers (floc) that protrude from the edge of the formed sheet. As the sheet is passed through the high temperature/high pressure calendar work roll nip, the "loose" floc and fibrid at the sheet edges adheres to the work roll and build up a significant deposit. Once the deposit builds up enough and the work roll oscillates the deposit back into the sheet edge, the thin papers can "stick" to and wrap around the roll. Since thin papers are not as stiff and strong as thicker papers, sheet breaks result frequently. For example, in the calendering of 130 micron (5 mil) papers with 250 fibers per centimeter protruding from the edges, calendar roll wraps can occur as frequently as 1 every 12,000 meters.

Accordingly, thin aromatic polyamide sheet structures which are readily calendered and which do not have a propensity for work roll wraps would be highly desirable.

SUMMARY OF THE INVENTION

In accordance with the invention, there is provided an elongate, nonwoven flexible sheet structure having two longitudinally-extending side edges. The sheet structure consists essentially of a commingled mixture of about 45 to about 70% by weight short fibers of aromatic polyamide and about 30 to about 55% by weight fibrids of poly(meta-phenylene isophthalamide). The sheet structure has an interior thickness remote from the edges of between about 75 and about 150 microns with a thickened area along and adjacent each of the side edges having a maximum thickness which is at least about 5% greater in average thickness than the interior thickness of the sheet along and adjacent the thickened areas.

In accordance with a preferred form of the present invention, the side edges of the sheet structure have less than about 150, most preferably less than about 75, of the short fibers per centimeter extending laterally outwardly from the side edges of the sheet by a distance greater than about 3 mm. Preferred sheets have thickened areas with an average width of between about 0.3 cm and about 0.5 cm. Preferably, the short fibers of the sheet consist essentially of short fibers of poly(meta-phenylene isophthalamide).

The invention also provides an improved process for making an elongate wet-laid nonwoven, flexible sheet structure having two longitudinally-extending side edges from a stock containing synthetic fibrous solids. Such processes include the steps of depositing the stock from a headbox onto an advancing wire to form a wet sheet of the fibrous solids having two initial edges defining a wet sheet width greater than the width of the sheet structure, dewatering the sheet, cutting the sheet adjacent the initial edges when partially dewatered to reduce the width of the sheet and provide each of the side edges, the cutting of the sheet being performed on the wire using a downwardly-directed water jet for each of the side edges, and drying to form the nonwoven sheet. The improvement in the process includes cutting the sheet adjacent each of the initial edges with at least a first water jet directed downwardly and away from the initial edge and toward the sheet with the jet being having sufficient volume and pressure to cut the sheet and to wash the fibrous solids produced by the cutting back into the sheet adjacent the side edges.

In one preferred process of the invention, the water jets are at a cross-direction angle between about 10° and about 45°, most preferably between about 20° and about 25°, from vertical away from the initial edge. Preferably, the water jets are at a machine direction angle between about 10° and about 45°, most preferably between about 25° and about 30°, from vertical in the direction of movement of the sheet on the wire.

Because papers in accordance with the invention have a thickened area along the edges, they behave in some respects as though they are thicker across their entire width which facilitates handling such as in calendering operations. In preferred sheets with less floc protruding from the edge, the papers are particularly suitable for calendering and provide a reduction in the number of work roll wraps normally experienced with thin papers.

DETAILED DESCRIPTION

The elongate, nonwoven sheet structure in accordance with the invention can be prepared from short fibers (floc) of an aromatic polyamide and fibrids of poly(meta-phenylene isophthalamide) (MPD-I). Suitable floc and fibrids for use in manufacturing papers in accordance with the invention can be prepared in accordance with the procedures set forth in U.S. Pat. No. 3,756,908, which is hereby incorporated by reference. Preferably, the short fibers of the floc are poly(-metaphenylene isophthalamide) fiber and have a length less than about 1.3 centimeters (0.5 inch). Typically, for 2 denier MPD-I fibers, an optimum length is about 0.69 centimeters (0.27 inch).

The floc and fibrids are commingled in the paper with the fibrids serving as a binder. In papers of the invention before calendering, the fine structure of the fibrids may be described generally as being "amorphous". Papers in accordance with the invention are made up of about 45 to about 70% floc by weight, preferably between about 50 and about 70% by weight when the floc is poly(metaphenylene isophthalamide). The papers are made up of about 30 to about 55% by weight fibrids, and in preferred papers, between about 30 and about 50% by weight.

Figure 5:
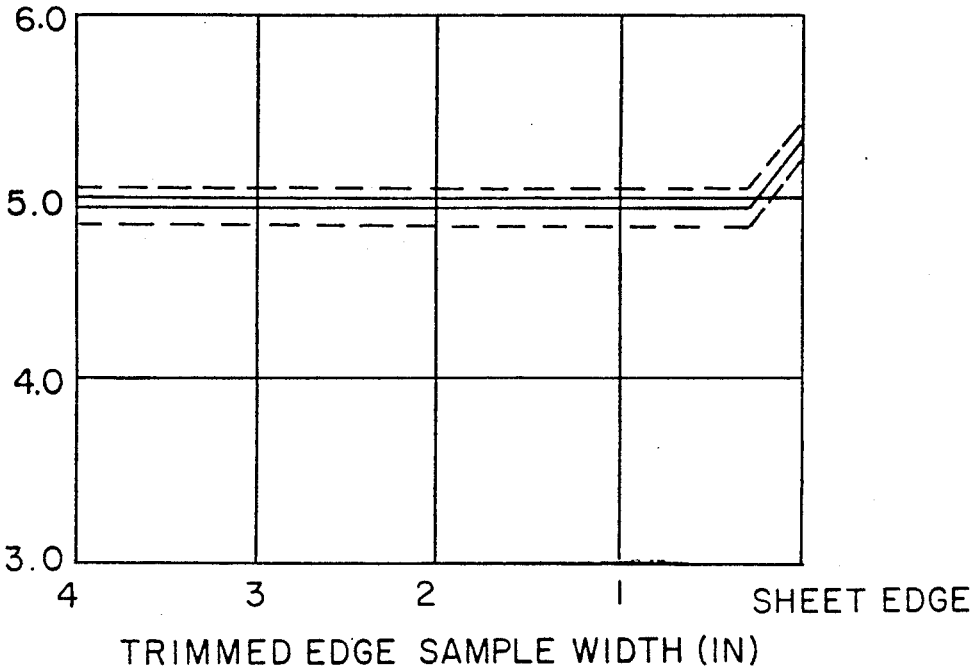
FIG. 5 is a graphical representation for the paper of Example 1 of uncalendered paper thickness plotted against the width from the sheet edge with the solid line being the average thickness and the broken lines illustrating high and low values.
Figure 6:
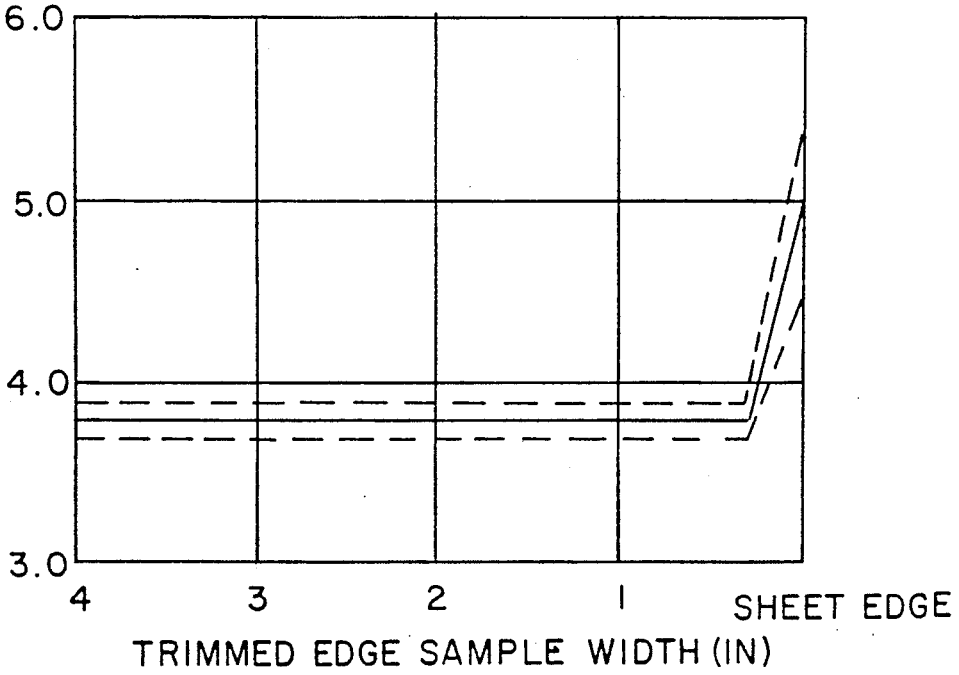
FIG. 6 is a similar graphical representation for the paper of Example 2.

Sheets in accordance with the invention have an interior thickness remote from the edges which ranges from between about 75 to about 150 microns (about 3 to about 6 mils). Along and adjacent each of the side edges of the sheet is a thickened area which has a maximum thickness at least about 5% greater in average thickness than the interior thickness of the sheet along and adjacent the thickened areas. As shown in FIGS. 5 and 6, the maximum thickness of the thickened area is typically at or closely adjacent the edge of the paper. In addition, the thickness or interior of the sheets and the thickened areas varies between high and low values when the thickness is measured at various locations along the edge. Thus, determining a maximum thickness which is at least about 5% greater in average thickness than the interior of the sheet generally requires that a number of measurements, for example, 10–12, be made at the same cross directional positions in relation to the edge but at different machine directional positions along the edge of a sheet until a relatively certain average value results. Preferably, the thickened area is between about 5% and about 25% thicker than the interior thickness when measured at a distance between about 1 and about 10 cm (0.4 to 4 inches) from the side edge. The thickened area preferably has a width of between about 0.3 and about 0.5 cm (0.1 to 0.2 inches).

When examined under a microscope, preferred papers in accordance with the invention have side edges with less than about 150, most preferably less than about 75, of the short fibers per centimeter extending laterally outwardly from the side edges by a distance greater than about 3 mm (0.1 inches).

Figure 1:
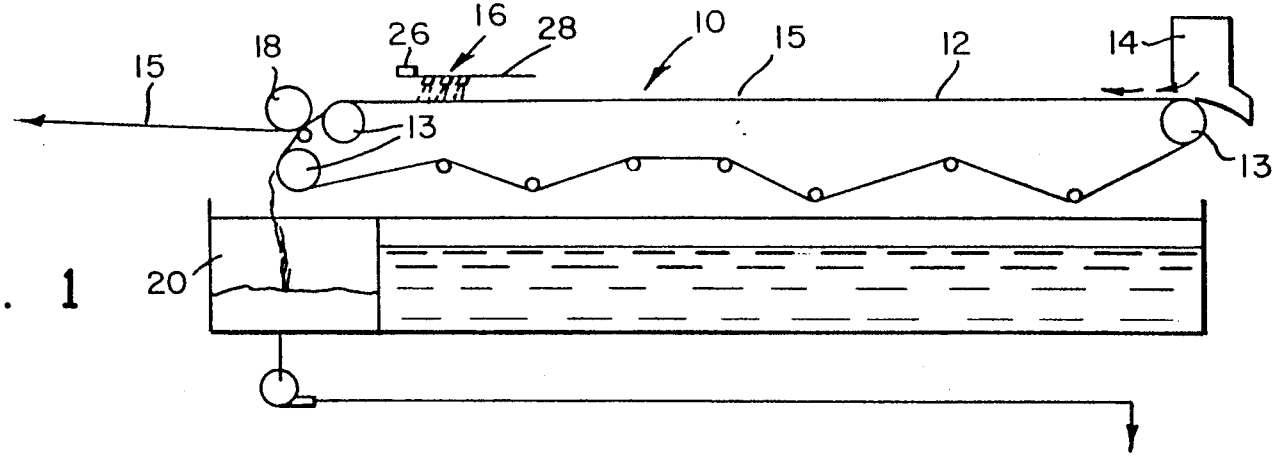
FIG. 1 is a schematic elevational view of apparatus useful in a process in accordance with the present invention.

Referring now to the drawings in which like reference characters designate like or corresponding parts throughout the several views, paper-making apparatus 10 useful for practicing a process in accordance with the invention is illustrated. With reference to FIG. 1, apparatus 10 is intended to represent a paper machine of the Fourdrinier type in which a generally horizontal wire 12 is moved by means of rolls 13 under a headbox 14. An aqueous stock containing synthetic fibrous solids is dispensed from the headbox 14 to form a wet sheet 15 on the wire. The wet sheet 15 travels on and is dewatered at least partially on the wire 12. A trimming station 16, as will be explained in more detail hereinafter, is provided on each edge of the sheet for removing a narrow portion of the sheet along the initial edges created during the deposition of the stock on the wire at the headbox. The initial edges are thereby removed and a sheet 15 of smaller width but with trimmed edges results.

After trimming, the trimmed sheet 15 passes under roll 18, leaves wire 12, and enters a wet press section (not shown) in which the sheet is further dewatered.

Figure 2:
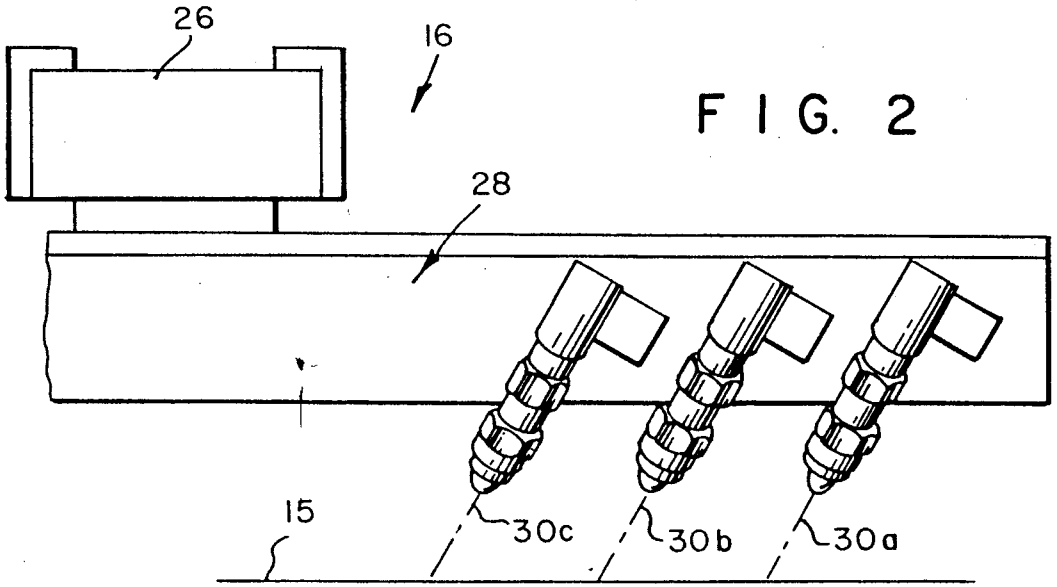
FIG. 2 is an enlarged elevational view of preferred water jets useful in a process in accordance with the present invention.
Figure 3:
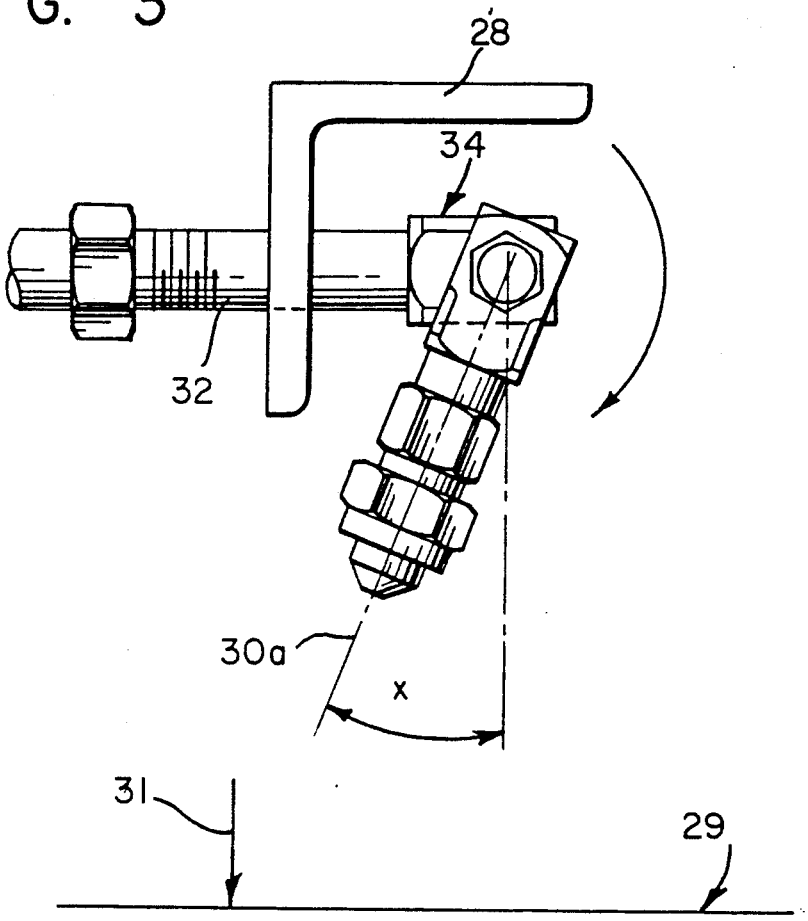
FIG. 3 is an enlarged elevational view illustrating the cross-direction angle of a preferred water jet in accordance with the present invention.
Figure 4:
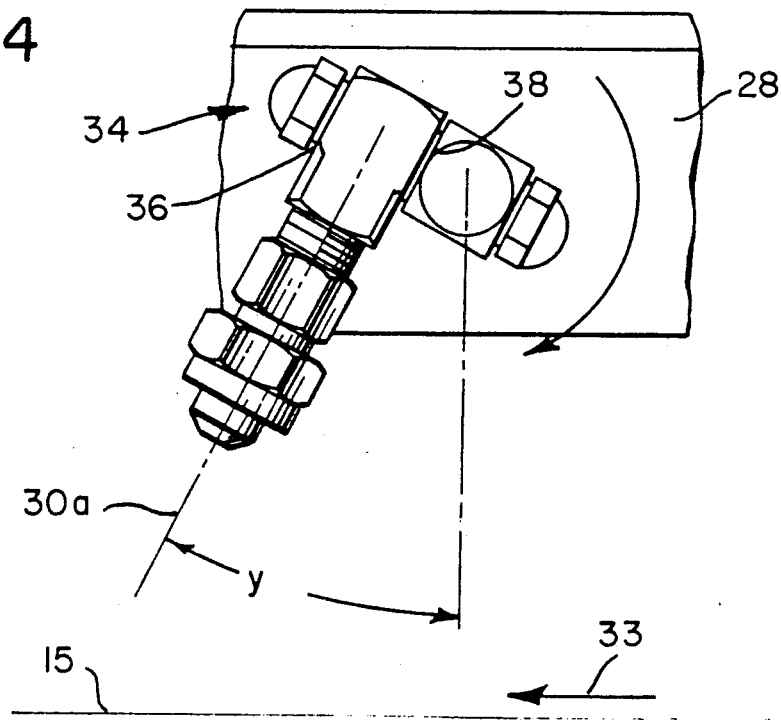
FIG. 4 is an enlarged elevational view showing the machine direction angle of a preferred water jet in accordance with the present invention.

With reference to FIGS. 2, 3 and 4, a preferred form of the trimming station 16 may be more fully understood. A crosspiece 26 is attached to a frame for the apparatus 10 (not shown) in a suitable manner and supports a trim water jet arm 28 on each side of the sheet 15 and is positioned above the sheet adjacent the initial edge 29 (FIG. 3). In the preferred embodiment depicted, three water jets, 30*a*, 30*b* and 30*c*, are directed from the trim water jet arm 28 for trimming the partially dewatered sheet and forming the trimmed edge, the approximate location of which is identified in FIG. 3 by arrow 31.

The water jets 30*a*, 30*b*, and 30*c* are directed downwardly and away from the initial edge of the wet sheet and also toward the interior of the sheet and have sufficient water volume and pressure to cut the sheet and wash the fiber solids produced by the cutting back into the sheet adjacent the newly formed trimmed side edges. This results in a thickened area along the paper edges with the effect being greater depending on the sheet width. For example, in a 130 micron (5 mil) paper, the area may be thickened by about 5–10%. In papers with a thickness of 100 micron (4 mil) and less, the thickness increase can be as much as 25%. The jets also reduce the number of fibers protruding from the edges of the formed sheets.

As shown in FIG. 3 depicting jet 30*a*, the water jets are preferably at a cross-directional angle (identified by the character x) of between about 10 and about 45 degrees from vertical away from the initial edge. Most preferably, angle x is between about 20 and about 25 degrees. With reference to FIG. 4, the jets are preferably at a machine direction angle identified by the character y of between about 10 and about 45 degrees from vertical in the direction of movement of the wet sheet (designated by arrow 33). Most preferably, the water jets are at a machine direction angle y of between about 25 and about 30 degrees.

The water jets 30*a*, 30*b*, and 30*c* can be provided by nozzles of the type which produce a neat, non-diverging single stream. A suitable orifice size for the nozzles is, for example, 0.5 to 1.3 mm (0.02 to 0.05 inches) when the water pressure is between 206 kPa (30 psi) and about 345 kPa (50 psi). Most preferably, water jet 30*c* provides a lower volume of water than the first water jet 30*a* since its function is primarily to "neaten" the edge produced by the cutting and washing action of the jets 30*a* and 30*b*. A suitable size for the orifice of the nozzles for the jet 30*c* is for example 0.5 to 0.75 mm (0.02 to 0.03 inches). In the preferred embodiment, the nozzles which provide the jets are about 6 cm (2.4 inches) above the wet sheet.

As illustrated in FIGS. 3 and 4, the angles of the water jets in the preferred embodiment are preferably adjustable in both the cross-direction and the machine direction. This is accomplished by nipple 32 which is connected to a source of pressurized water and is suitably secured in a bore in the trim water jet arm 28 such as by welding. A single swivel nozzle 34 is suitably used to provide the jets and is threadably fitted to the nipple 32 and can be adjusted on the nipple 32 to set the machine direction angle y. The swivel nozzle preferably includes a washer 36 and an O-ring 38 in the swivel so that the cross-directional angle can be adjusted to align the water jets in use without a shutdown of the process.

EXAMPLES

In this following examples, fibrids and floc were prepared as described in U.S. Pat. No. 3,756,908. Ratios and percentages described in the examples are by weight unless otherwise specified. Paper thickness was determined, using unconditioned edge trim samples, by measuring using a TMI (Testing Machines Inc., Amityville, Long Island, N.Y.) Series 49-70 Analog Bench Micrometer with a 1.27 cm (½") diameter foot. The samples measured were about 15 cm (6 inches) long and, for each cross-directional position, 12 measurements were made at about 1.25 cm (0.5 inch) intervals along the length of the samples to arrive at the plotted average, high and low thickness values for the interior and thickened edge areas. The numbers of protruding fibers extending from the edges by more than 3 mm were counted with the aid of an optical microscope over a distance of 1 cm (0.4 inch).

EXAMPLE 1

This example describes the manufacture of a 130 micron (5 mil - nominal) paper in accordance with the present invention.

Poly(metaphenylene isophthalamide) floc fibers having a length of 0.27 in (0.68 cm) were added to a slurry of refined fibrids to produce a slurry with a total solids concentration of about 0.31% and floc/fibrids ratio of 48/52. The slurry was agitated to keep the floc and fibrids well dispersed The blended floc/fibrid slurry was then supplied to the headbox of apparatus as illustrated in FIGS. 1-4 which produced a wet sheet with a width of 200 cm which, when dried, resulted in a 130 micron (5 mil) paper.

The partially dewatered sheet was trimmed using three water jets on each side with the first two jets having an orifice of 0.991 mm (0.039 inches) and the third jet had an orifice of 0.508 mm (0.020 inches). All of the jets had a cross-direction angle of 25° and a machine direction angle of 25° and water was supplied to the jets at a pressure of 241 kPa (35 psi). As discussed in relation to FIG. 1, the trimmed and partially dewatered sheet was transferred from the forming wire to a wet press to reduce its water content and then to a series of steam-heated dryer cans heated to a maximum temperature of 166° C. The paper was dried to at least 95% solids and wound into a roll.

FIG. 5 illustrates the thickness profile in relation to the distance from the edge of the dried paper. The solid line indicates average width and the dotted lines indicate high and low values. The paper of this example had an average of about 20 short fibers per centimeter extending from the edge by a distance of greater than 3 mm.

The as-formed paper was hot-calendered using steel rolls and the calendering process experienced approximately 1 calendar work roll wrap every 200,000 meters.

EXAMPLE 2

The same procedures as in Example 1 were used except that less stock was discharged from the headbox to produce a 4 mil (nominal) paper.

For this paper, FIG. 6 illustrates the paper thickness in relation to distance from the trimmed edge. The paper of this example had an average of about 15 short fibers per centimeter extending from the edge by a distance of greater than 3 mm.

The as-formed paper was hot-calendered using steel rolls and the calendering process experienced approximately the same frequency of calendar roll wraps as in Example 1, about 1 calendar work roll wrap every 200,000 meters.

What is claimed is:

1. An elongate, nonwoven flexible sheet structure having two longitudinally-extending side edges, said sheet structure consisting essentially of a commingled mixture of about 45 to about 70% by weight short fibers of aromatic polyamide and about 30 to about 55% by weight fibrids of poly(meta-phenylene isophthalamide), said sheet structure having an interior thickness remote from said edges of between about 75 and about 150 microns with a thickened area along and adjacent each of said side edges, said thickened area having a maximum thickness which is at least about 5% greater in average thIckness than the interior thickness of said sheet along and adjacent said thickened areas.

2. The sheet structure of claim 1 wherein said side edges of said sheet structure have less than about 150 of said short fibers per centimeter extending laterally outwardly from said side edges of said sheet structure by a distance greater than about 3 mm.

3. The sheet structure of claim 1 wherein said side edges of said sheet structure have less than about 75 of said short fibers per centimeter extending laterally outwardly from the said side edges of said sheet structure by a distance greater than about 3 mm.

4. The sheet structure of claim 1 wherein said maximum thickness of said thickened area is between about 5% and about 25% thicker than said interior thickness measured at a distance between about 1 and about 10 cm from said edge.

5. The sheet structure of claim 1 wherein said thickened area has an average width between about 0.3 cm and about 0.5 cm.

6. The sheet structure of claim 1 wherein said short fibers consist essentially of short fibers of poly(metaphenylene isophthalamide).

7. The sheet structure of claim 6 wherein said short fibers have a length of less than about 1.3 cm.

8. The sheet structure of claim 6 consisting essentially of about 50 to about 70% by weight short fibers of poly(meta-phenylene isophthalamide) and about 30 to about 50% fibrids of poly(meta-phenylene isophthalamide).

9. The sheet structure of claim 6 wherein said fibrids are amorphous.

10. In a process for making an elongate wet-laid nonwoven, flexible sheet structure having two longitudinally-extending side edges from a stock containing synthetic fibrous solids, said process including the steps of depositing the stock from a headbox onto an advancing wire to form a wet sheet of said fibrous solids having two initial edges defining a wet sheet width greater than the width of said sheet structure, dewatering said sheet, cutting said sheet adjacent said initial edges when partially dewatered to reduce the width of the sheet and provide each of said side edges, said cutting of said sheet being performed on the wire using a downwardly-directed water jet for each of said side edges, and drying to form said nonwoven sheet, the improvement comprising:

cutting said sheet adjacent each of said initial edges with at least a first-water jet directed downwardly and away from said initial- edge and toward the sheet, said jet having sufficient volume and pressure to cut the sheet and to wash the fibrous solids produced by said cutting back into said sheet adjacent said side edges.,

11. The process of claim 10 wherein said water jets are at a cross-direction angle between about 3 and about 45° from vertical away from said initial edge.

12. The process of claim 11 wherein said water jets are at a cross-direction angle of between about 20 and about 25° from vertical.

13. The process of claim 10 wherein said water jets are at a machine direction angle between about 3 and about 45° from vertical in the direction of movement of the sheet on the wire.

14. The process of claim 13 wherein said water jets are at a machine direction angle of between about 25 and about 30° from vertical.

15. The process of claim 10 wherein said cutting of said sheet is performed with at least a first and a second water jet.

16. The process of claim 10 wherein said cutting of said sheet is performed with at least a first, a second, and a third water jet, said third water jet having a lower volume than said first water jet.

17. The process of claim 10 wherein said water jets wash fibrous material produced from said cutting into said sheet to produce a thickened area adjacent said side edges of said sheet, said thickened area having a maximum thickness which is at least about 5% greater in average thickness than the interior of the sheet along and adjacent said thickened areas.

18. The process of claim 17 wherein said water jets produce a thickened area having a maximum thickness of between about 5% and about 25% greater than the thickness of the interior of the sheet measured at a distance between about 1 and about 10 cm from said edge.

19. The process of claim 10 wherein said solids of said stock consist essentially of a mixture of about 45 to about 70% by weight short fibers of aromatic polyamide and about 30 to about 55% by weight fibrids of poly(meta-phenylene isophthalamide).

20. The process of claim 10 wherein said short fibers consist essentially of short fibers of poly(meta-phenylene isophthalamide).

21. The process of claim 10 wherein said water jets wash fibrous material produced from said cutting into said sheet so that said side edges of said sheet structure have less than about 150 of said short fibers per centimeter extending laterally outwardly from the said side edges of said sheet by a distance greater than about 3 mm.

22. The process of claim 10 wherein said water jets wash fibrous material produced from said cutting into said sheet so that said side edges of said sheet structure have less than about 75 of said short fibers per centimeter expending laterally outwardly from the said side edges of said sheet by a distance greater than about 3 mm.

23. The process of claim 10 wherein said sheet structure has an interior thickness remote from said side edges of between about 75 and about 150 microns.

* * * * *